US008766866B2

(12) United States Patent
Ro et al.

(10) Patent No.: US 8,766,866 B2
(45) Date of Patent: Jul. 1, 2014

(54) LOG PERIODIC ANTENNA

(75) Inventors: Haeng-Sook Ro, Daejeon (KR); Gwang-Moon Park, Daejeon (KR); Sang-Tae Kim, Daejeon (KR); Seong-Yun Lee, Daejeon (KR); Mi-Kyung Suk, Daegu (KR); Heung-Yong Kang, Daejeon (KR); Yong-Seok Choi, Daejeon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 589 days.

(21) Appl. No.: 12/818,220

(22) Filed: Jun. 18, 2010

(65) Prior Publication Data

US 2011/0148729 A1 Jun. 23, 2011

(30) Foreign Application Priority Data

Dec. 21, 2009 (KR) ..... 10-2009-0128521

(51) Int. Cl.
*H01Q 11/10* (2006.01)

(52) U.S. Cl.
CPC ..... *H01Q 11/10* (2013.01)
USPC ..... 343/792.5

(58) Field of Classification Search
CPC ..... H01Q 11/10; H01Q 11/105
USPC ..... 343/792.5
See application file for complete search history.

(56) References Cited

U.S. PATENT DOCUMENTS

| | | | | | |
|---|---|---|---|---|---|
| 3,108,280 | A | * | 10/1963 | Mayes et al. | 343/792.5 |
| 3,193,831 | A | * | 7/1965 | Yang | 343/792.5 |
| 3,362,026 | A | * | 1/1968 | Smith, Jr. et al. | 343/752 |
| 4,360,816 | A | * | 11/1982 | Corzine | 343/792.5 |

FOREIGN PATENT DOCUMENTS

| | | | |
|---|---|---|---|
| KR | 10-2004-0090121 | A | 10/2004 |
| KR | 20040090122 | A | 10/2004 |
| KR | 20060066717 | A | 6/2006 |
| KR | 10-2006-0099308 | A | 9/2006 |
| KR | 10-2007-0080395 | A | 8/2007 |

OTHER PUBLICATIONS

Yang Zhengguang et al., "A Size-Reduced Log Periodic Dipole Antenna", Journal of Eelctronics (China), vol. 23 No. 6, Nov. 2006, pp. 913-914.

K. K. Chan et al., "Analysis of the Log-Periodic V-Dipole Antenna", IEEE Transactions on Antennas and Propagation, vol. AP-23, May 1975, pp. 397-401.

* cited by examiner

*Primary Examiner* — Robert Karacsony
(74) *Attorney, Agent, or Firm* — Rabin & Berdo, P.C.

(57) ABSTRACT

A log periodic antenna includes first and second transmission lines parallel with each other; and a plurality of broadband radiation elements having first sides electrically connected to the first and second transmission lines, a predetermined angle being defined between the first sides of the broadband radiation elements and the first and second transmission lines, and second sides not electrically connected with the first and second transmission lines, the second sides having radiation surfaces larger than radiation surfaces of the first sides. A plurality of broadband radiation elements electrically connected with the first transmission line and a plurality of broadband radiation elements electrically connected with the second transmission line are positioned to face each other with reference to the first and second transmission lines.

9 Claims, 16 Drawing Sheets

LOG PERIODIC ANTENNA

CROSS-REFERENCE(S) TO RELATED APPLICATIONS

The present application claims priority of Korean Patent Application No. 10-2009-0128521, filed on Dec. 21, 2009, which is incorporated herein by reference in its entirety.

BACKGROUND OF THE INVENTION

1. Field of the Invention

Exemplary embodiments of the present invention relate to a log periodic antenna; and, more particularly, to a log periodic antenna having a reduced beam width of the H-surface radiation pattern and high-gain directivity.

2. Description of Related Art

In general, an antenna is configured to convert electric signals, which are described in terms of voltage/current, into electromagnetic waves, which are described in terms of electric/magnetic fields, and vice versa. Antennas include dipole antennas, monopole antennas, patch antennas, horn antennas, parabolic antennas, helical antennas, slot antennas, log periodic antennas, etc.

The log periodic antennas have broadband characteristics and a suitable level of gain, and thus are widely used for TV reception or communication. The type of broadcasting and communication services has recently become more diversified, such as IMT-2000, wireless LAN, portable wireless Internet, etc. As a result, there is an increasing demand for antennas capable of covering broadband, dual-band, triple-band, etc, and the availability of log periodic antennas is also increasing in this connection.

The log periodic antennas are classified, according to the type of repeated structure, toothed planar antennas, toothed trapezoid antennas, trapezoid wire antennas, and zigzag wire antennas. Among the log periodic antennas of various shapes, log periodic dipole antennas having an array of planar or wired dipoles are widely used.

A typical broadband log periodic dipole antenna includes a series of serially-fed dipole radiation elements, and its design parameters include the geometric ratio of the log periodic structure ($\tau$), spacing factor ($\sigma$), and the length ($\lambda/2$) of a single dipole antenna of a specific band. Therefore, any attempt to reduce the length of the dipole radiation elements and the overall size is limited. In other words, higher gain may be obtained by increasing the geometric ratio of the log periodic structure ($\tau$) and spacing factor ($\sigma$), but the length of the antenna boom and the number of radiation elements inevitably increase, making the overall antenna size bigger.

Recent wireless communication systems have a tendency towards broadband characteristics or smaller sizes. This means that element development is directed to reducing the overall antenna size while maintaining broadband characteristics.

In an attempt to solve the above-mentioned problem, it has been proposed to replace the dipole radiation elements of a log periodic dipole antenna with loop elements so that the element length is reduced. It has also been proposed to bend the end of dipole radiation elements, or employ size-reduced or foreshortened dipoles.

These approaches may reduce the length of dipole radiation elements, but cannot increase the gain. Therefore, log periodic antennas having a small beam width and good directivity, which are applicable to wireless communication systems, must come in a different type.

In the case of a wireless communication system where an antenna is moved to measure the strength of received signals and find the direction from which radio waves are transmitted, specifically a portable direction finding system, a conventional log periodic dipole antenna is usually employed. This has problems in that the overall antenna size is only large in the two-dimensional plane, and the 3 dB beam width of the H-surface radiation pattern is as large as 120°, making signal direction finding unreliable. Therefore, improvement of directivity based on high-gain structure, combined with the trend towards broadband characteristics and small sizes of log periodic dipole antennas, is a prerequisite for higher direction finding accuracy of direction finding systems.

Consequently, it is requested to develop a log periodic antenna having a small beam width and high gain while maintaining the broadband characteristics of conventional log periodic antennas.

SUMMARY OF THE INVENTION

An embodiment of the present invention is directed to a log periodic antenna having a reduced beam width of the H-surface radiation pattern and high-gain directivity.

Another embodiment of the present invention is directed to a log periodic antenna capable of maintaining broadband characteristics.

Another embodiment of the present invention is directed to a log periodic antenna having a volume smaller than a conventional log periodic antenna.

Another embodiment of the present invention is directed to a log periodic antenna which can be fabricated and assembled easily and which can be carried conveniently.

Another embodiment of the present invention is directed to a log periodic antenna which can accurately find the direction in a system (e.g. portable direction finding system) requiring a higher degree of directivity than a conventional log periodic antenna.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a log periodic antenna includes first and second transmission lines parallel with each other; and a plurality of broadband radiation elements having first sides electrically connected to the first and second transmission lines, a predetermined angle being defined between the first sides of the broadband radiation elements and the first and second transmission lines, and second sides not electrically connected with the first and second transmission lines, the second sides having radiation surfaces larger than radiation surfaces of the first sides, wherein a plurality of broadband radiation elements electrically connected with the first transmission line and a plurality of broadband radiation elements electrically connected with the second transmission line are positioned to face each other with reference to the first and second transmission lines.

The predetermined angle may be an acute angle.

The second sides of the plurality of broadband radiation elements not electrically connected with the first and second transmission lines may have polygonal or circular radiation surfaces.

Each of the plurality of broadband radiation elements may have a length gradually increasing from first sides of the first and second transmission lines, a feed signal being applied to the first sides, towards second sides opposite the first sides, and a plurality of broadband radiation elements formed on the first sides of the first and second transmission lines may be linear dipole radiation elements.

The log periodic antenna may further include: a first broadband antenna unit including the first and second transmission lines and the plurality of broadband radiation elements; a second broadband antenna unit including the first and second transmission lines and the plurality of broadband radiation elements; and a feeder configured to supply the first and second broadband antenna units with a feed signal. The first and second broadband antenna units may be symmetrically arranged in a pyramidal shape while sharing the feeder with each other.

The first and second broadband antenna units may have an included angle ($\gamma$) of $0° < \gamma < 180°$.

The feeder may include: a first feeding point configured to electrically connect the first transmission line of the first broadband antenna unit with the first transmission line of the second broadband antenna unit; and a second feeding point configured to electrically connect the second transmission line of the first broadband antenna unit with the second transmission line of the second broadband antenna unit. The first feeding point may be electrically connected with an central conductor of a coaxial line, and the second feeding point may be electrically connected with a outer conductor of the coaxial line.

DESCRIPTION OF SPECIFIC EMBODIMENTS

Figure 1:
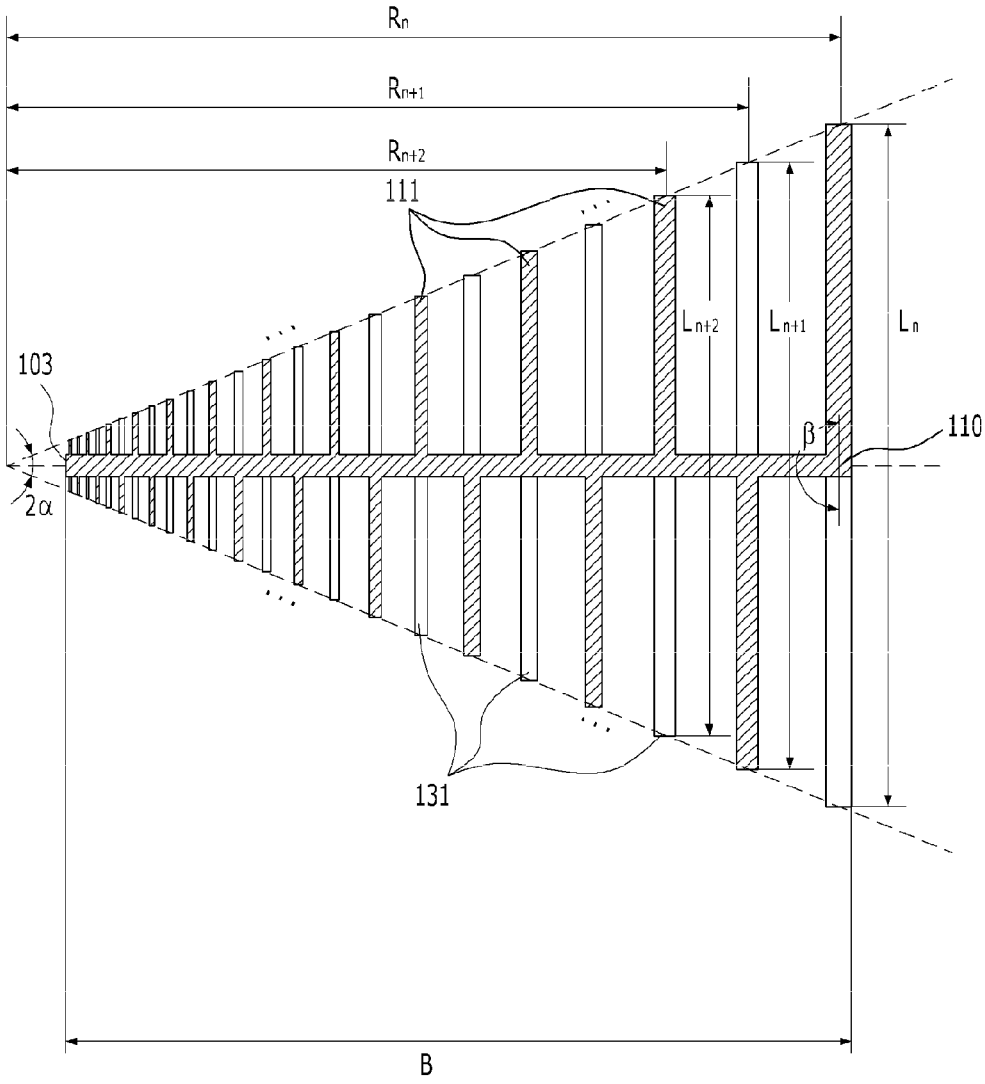
FIG. 1 PRIOR ART
FIG. 1 is a top view of a conventional log periodic dipole antenna.

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Figure 2:
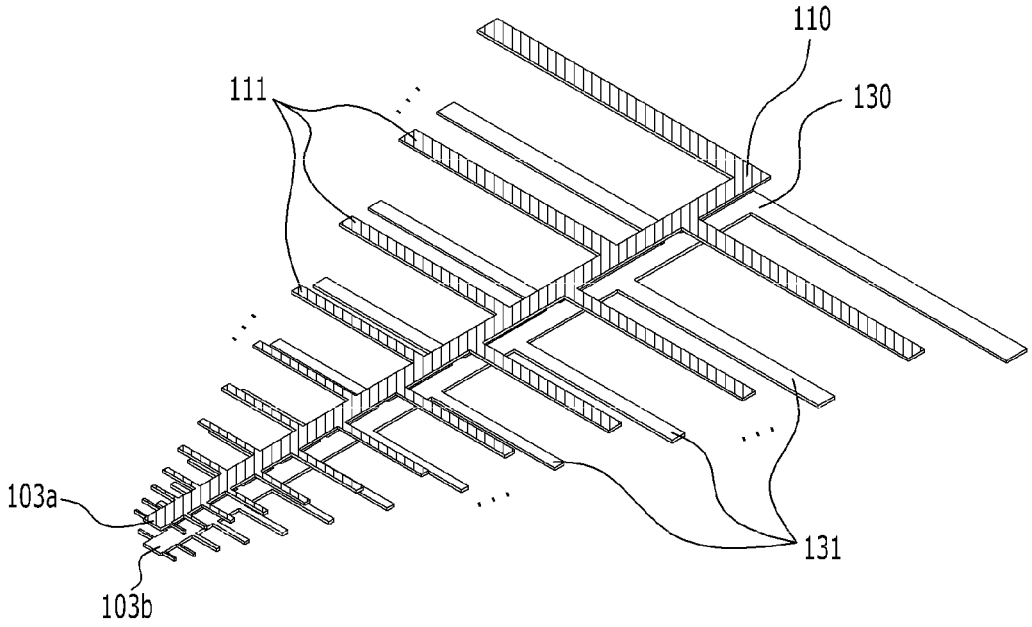
FIG. 2 PRIOR ART
FIG. 2 is a perspective view of the conventional log periodic dipole antenna illustrated in FIG. 1.

FIG. 1 is a top view of a conventional log periodic dipole antenna, and FIG. 2 is a perspective view of the conventional log periodic dipole antenna illustrated in FIG. 1.

Referring to FIG. 2, the conventional log periodic dipole antenna includes parallel transmission lines consisting of first and second transmission lines 110 and 130, a first feed terminal 103*a* formed on one side of the first transmission line 110, a second feed terminal 103*b* formed on one side of the second feed line 130, a plurality of first dipole elements arranged on the first transmission line 110 at ±90° with reference to the first transmission line 110, and a plurality of second dipole elements arranged on the second transmission line 130 at ±90° with reference to the second transmission line 130.

Among the first dipole elements, dipole elements 111 arranged at 90° with reference to the first transmission line 110 and dipole elements arranged at −90° are positioned so as not to face each other with reference to the first transmission line 110. The second dipole elements are positioned in the same manner. It is to be noted, however, that the first dipoles 111 arranged at 90° with reference to the first transmission line 110 and the second dipole elements 131 arranged at −90° with reference to the second transmission line 130 are positioned to face each other with reference to the first and second transmission lines 110 and 130.

In the case of such a conventional log periodic dipole antenna, the length ($L_1, L_2, -L_{n+1}$) of each dipole element, the distance ($d_1, d_2-, d_{n+1}$) between the dipole elements, and the length of the first and second transmission lines 110 and 130 predetermined by the band of operating frequency, the geometric ratio of the log periodic structure ($\tau$), spacing factor ($\sigma$) and apex half angle ($\alpha$) of the log periodic antenna. The geometric ratio ($\tau$) and spacing factor ($\sigma$) of the log periodic antenna are defined by Equations 1 and 2 below.

$$\tau = \frac{R_{n+1}}{R_n} = \frac{L_{n+1}}{L_n} \quad (n = 1, 2, 3, \ldots, N-1) \qquad \text{Eq. 1}$$

$$\sigma = \frac{R_n - R_{n+1}}{2L_n} = \frac{d_n}{2L_n} \quad (n = 1, 2, 3, \ldots, N-1) \qquad \text{Eq. 2}$$

Figure 3:
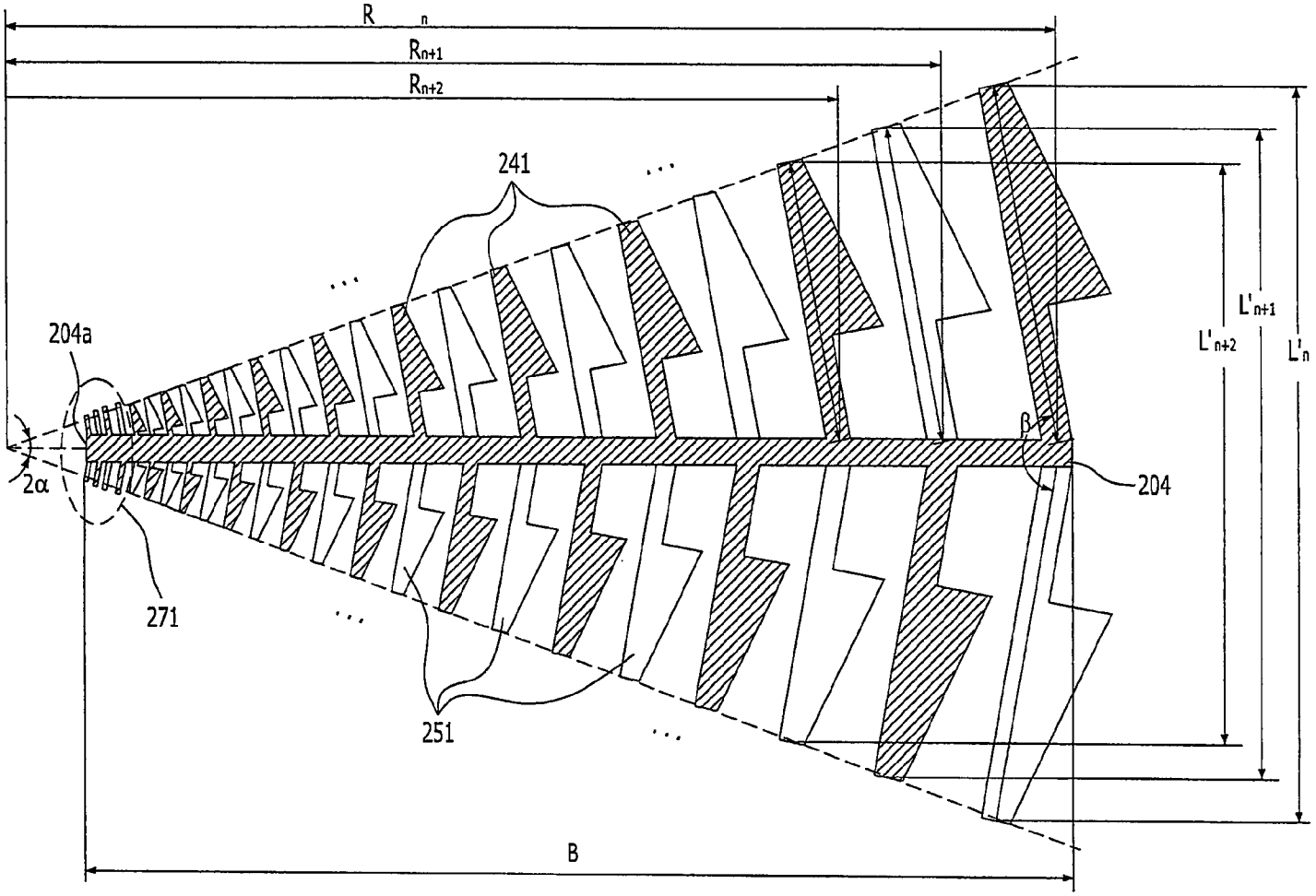
FIG. 3 is a top view of a log periodic antenna in accordance with an embodiment of the present invention.
Figure 4:
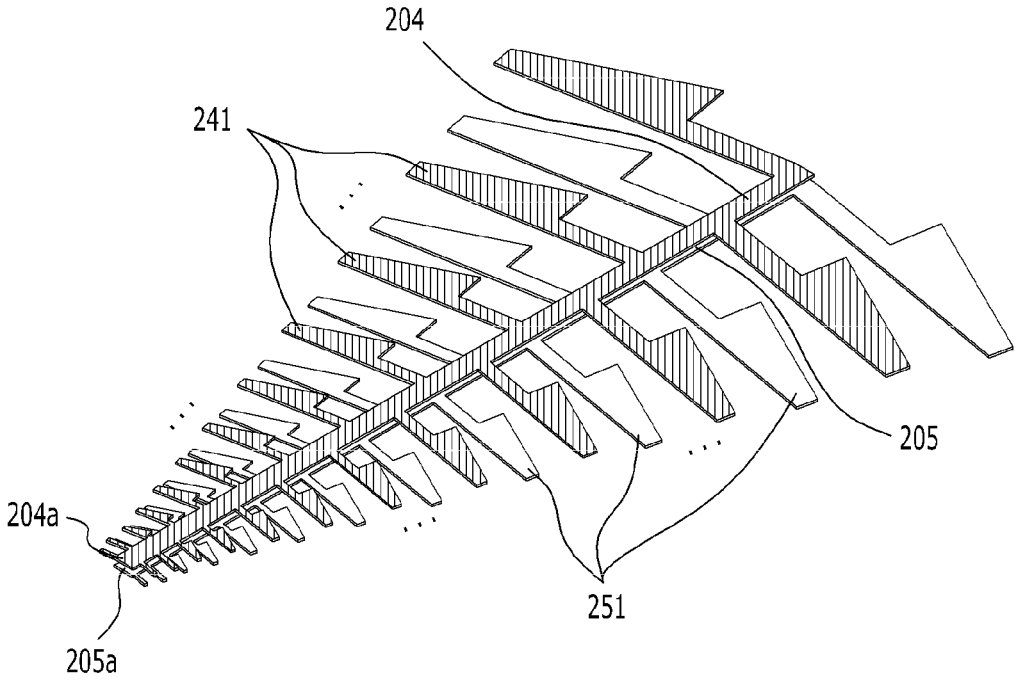
FIG. 4 is a perspective view of the log periodic antenna in accordance with an embodiment of the present invention illustrated in FIG. 3.

FIG. 3 is a top view of a log periodic antenna in accordance with an embodiment of the present invention, and FIG. 4 is a perspective view of the log periodic antenna in accordance with an embodiment of the present invention illustrated in FIG. 3.

Referring to FIGS. 3 and 4, the log periodic antenna in accordance with an embodiment of the present invention includes first and second transmission lines 204 and 205 and a plurality of broadband radiation elements 241 and 251.

The first and second transmission lines 204 and 205 are positioned parallel with each other. The first transmission line 204 has one side 204*a* electrically connected with a feeder (not shown) configured to apply a feed signal. The second transmission line 205 has one side 205*a* electrically connected with the feeder (not shown) configured to apply a feed signal. The first transmission line 204 is electrically connected with a plurality of broadband radiation elements 241, and the first transmission line 204 and the broadband radiation elements 241 define a predetermined angle (±β/2) therebetween. The angle (±β/2) between the first transmission line 204 and the broadband radiation elements 241 is larger than 0° and smaller than ±90° (i.e. acute angle). Similarly, the second transmission line 205 and a plurality of broadband radiation elements 251, which are electrically connected with the second transmission line 205, define an acute angle therebetween.

The plurality of broadband radiation elements 241 and 251 are spaced from each other and connected to the first and second transmission lines 204 and 205. One side of each of the plurality of broadband radiation elements 241 and 251 is electrically connected to the first and second transmission lines 204 and 205, and the other side thereof is arranged in free space.

The length of each of the plurality of broadband radiation elements 241 and 251 gradually increases at a predetermined ratio from one side 204*a* and 205*a* of the first and second transmission lines 204 and 205 towards the other side thereof. The plurality of broadband radiation elements 241, which are electrically connected with the first transmission line 204, and the plurality of broadband radiation elements 251, which are electrically connected with the second transmission line 205, are arranged so as to face each other with reference to the first and second transmission lines 204 and 205.

The angle (±β/2) between the plurality of broadband radiation elements 241 and 251 and the first and second transmission lines 204 and 205 may be 90° as in the case of a conventional log periodic dipole antenna, but is larger than 0° and smaller than 90° to reduce the size of the log periodic antenna and improve the directivity in accordance with an embodiment of the present invention. Therefore, the broadband radiation elements 241 and 251, which face each other with reference to the first and second transmission lines 204 and 205, define β° therebetween. Considering that the broadband radiation elements 241 and 251, which face each other with reference to the first and second transmission lines 204 and 205, define an angle of 0°-180°, this configuration will hereinafter referred to as V-shaped arrangement.

One side of each of the plurality of broadband radiation elements 241 and 251, which is electrically connected with the first and second transmission lines 204 and 205, has the shape of a conventional dipole antenna, but the other side thereof, which is arranged in free space, has the shape of a right-angled triangle, not that of a conventional dipole antenna. Specifically, the other side arranged in free space has a radiation surface larger than that of the side connected with the first and second transmission lines 204 and 205. It is to be noted that, although the radiation surface of the side arranged in free space is illustrated in FIGS. 3 and 4 as a right-angled triangle, the radiation surface may also has a polygonal or circular shape. Forming the radiation surface of the side arranged in free space in a polygonal or circular shape can reduce the length of the broadband radiation elements 241 and 251 compared with conventional dipole shapes. This makes the antenna smaller.

Among the plurality of broadband radiation elements 241 and 251 connected to the first and second transmission lines 204 and 205, a plurality of broadband radiation elements 271 formed near one side 204*a* and 205*a* of the first and second transmission lines 204 and 205 may have the shape of a conventional dipole antenna. This is because too small length or width of the plurality of broadband radiation elements 271 makes precise processing difficult during fabrication and may cause deformation. The plurality of broadband radiation elements 241 and 251 follow design parameters defined by above Equations 1 and 2 as in the case of a conventional log periodic dipole array antenna.

Figure 5:
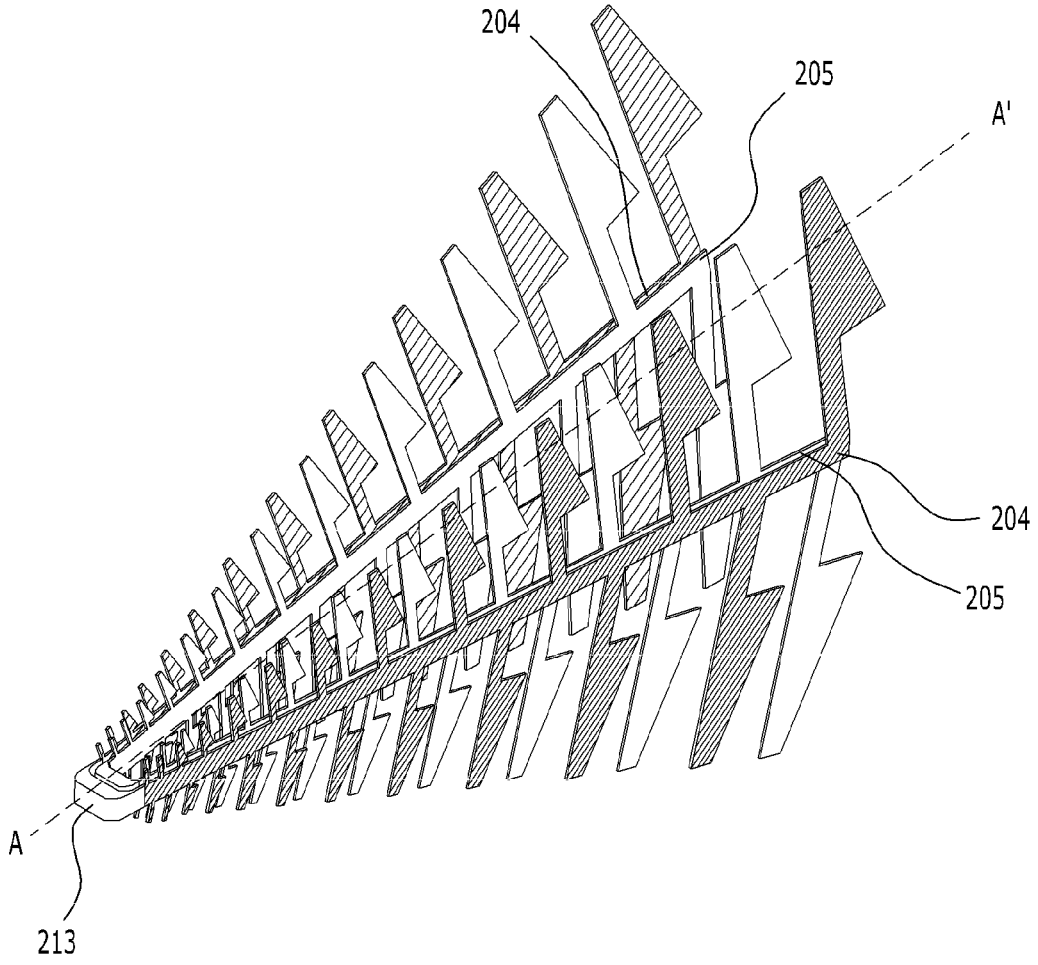
FIG. 5 is a perspective view of a pyramidal log periodic antenna in accordance with another embodiment of the present invention.
Figure 6:
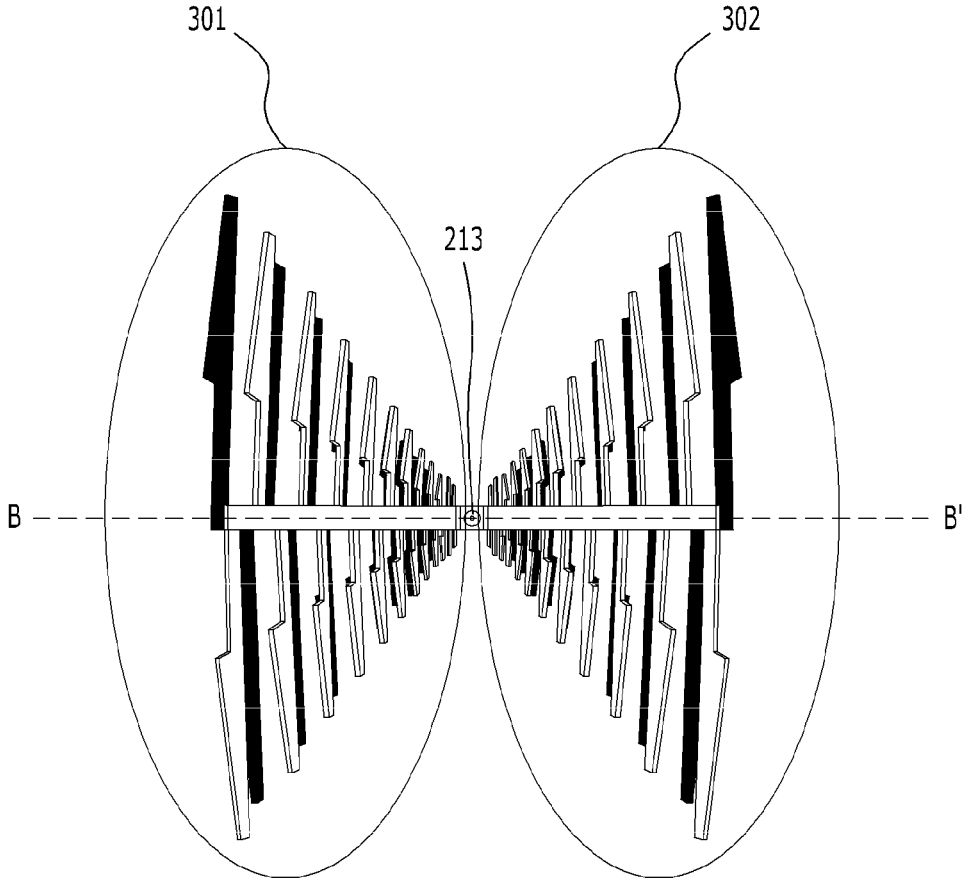
FIG. 6 is a rear view of the pyramidal log periodic antenna in accordance with another embodiment of the present invention illustrated in FIG. 5.
Figure 7:
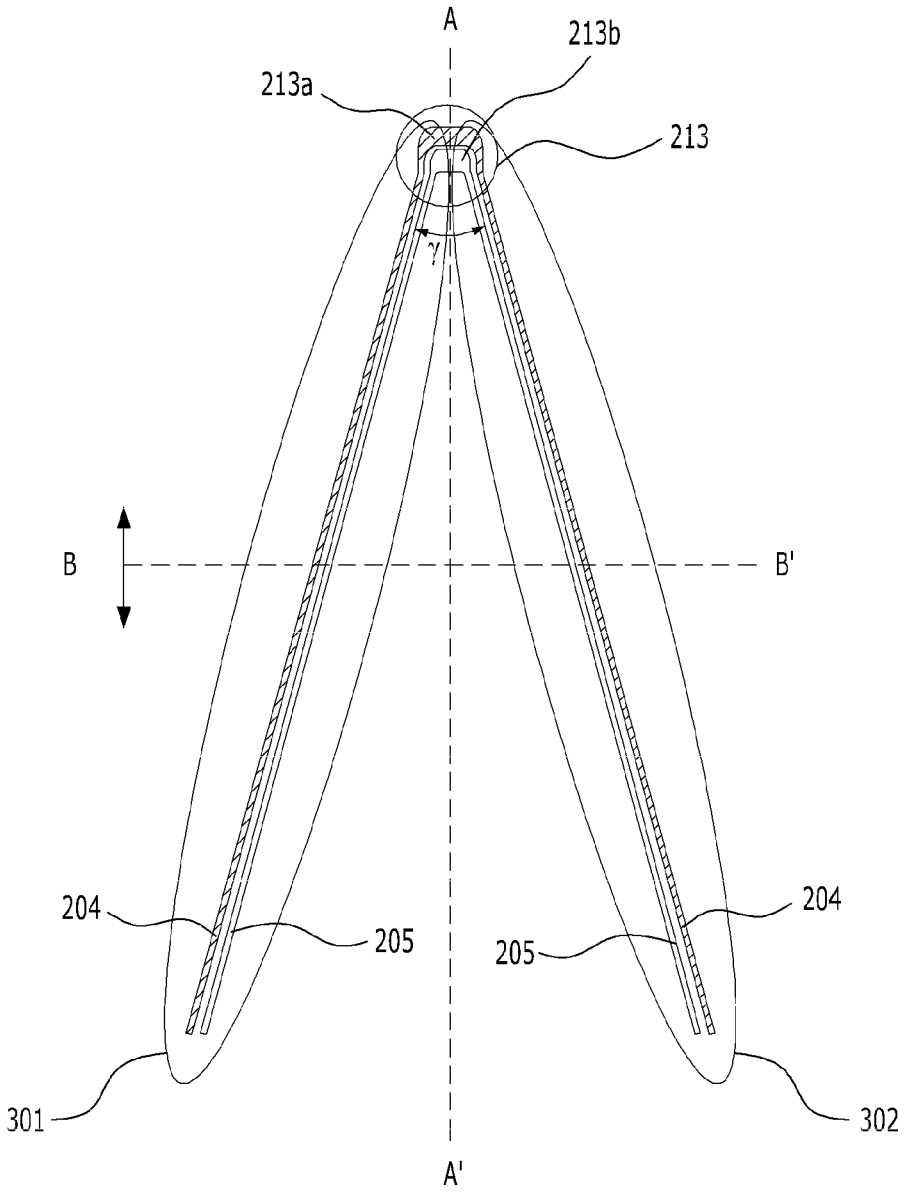
FIG. 7 is a top view of the pyramidal log periodic antenna in accordance with another embodiment of the present invention illustrated in FIG. 5.
Figure 8:
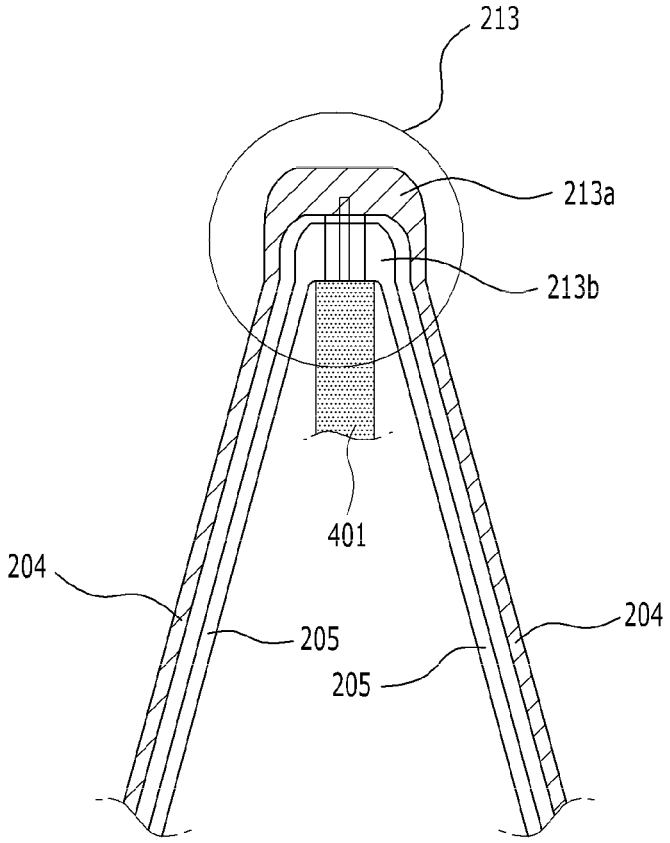
FIG. 8 is an enlarged view of a feeder of the pyramidal log periodic antenna in accordance with another embodiment of the present invention illustrated in FIG. 5.

FIGS. 5 to 8 illustrate a log periodic antenna in accordance with another embodiment of the present invention. Specifically, FIG. 5 is a perspective view of a log periodic antenna in accordance with another embodiment of the present invention, FIG. 6 is a rear view of the log periodic antenna in accordance with another embodiment of the present invention, FIG. 7 is a top view of the log periodic antenna in accordance with another embodiment of the present invention, and FIG. 8 is an enlarged view of a feeder of the log periodic antenna in accordance with another embodiment of the present invention.

The log periodic antenna in accordance with another embodiment of the present invention illustrated in FIGS. 5 and 6 is a combination of two log periodic antennas in accordance with an embodiment of the present invention illustrated in FIGS. 3 and 4. The two log periodic antennas are supplied with a feed signal via a common feeder 213.

More specifically, referring to FIGS. 5 and 6, the log periodic antenna in accordance with another embodiment of the present invention includes first and second broadband antenna units 301 and 302 which are arranged to face each other with reference to a first reference axis A-A' and which have a common feeder 213. The log periodic antenna in accordance with another embodiment of the present invention has a pyramidal overall shape. Therefore, the log periodic antenna in accordance with another embodiment of the present invention will hereinafter be referred to as a pyramidal log periodic antenna.

The first reference axis A-A' corresponds to the central axis extending through the apex of the feeder 213 of the pyramidal log periodic antenna and the center of the base surface. With reference to the first reference axis A-A', first and second surfaces are symmetrical, and third and fourth surfaces are symmetrical. Specifically, assuming that the first broadband antenna unit 301 is arranged on the first (or third) surface of a tetrahedron, the second broadband antenna unit 302 is arranged on the second (or fourth) surface of the tetrahedron. Therefore, the first and second broadband antenna units 301 and 302 define a predetermined angle γ therebetween as shown in FIG. 7. The angle γ is larger than 0° and smaller than 180° in accordance with this embodiment.

The plurality of broadband radiation elements of the first and second broadband antenna units 301 and 302 define ±90° between each other with reference to a second reference axis B-B'.

Referring to FIGS. 7 and 8, the pyramidal log periodic antenna in accordance with another embodiment of the present invention has a central feeding structure 213 connected with a coaxial transmission line 401. More specifically, the central feeding structure 213 has the shape of a coaxial transmission line. A coaxial transmission line 401 is inserted into the central feeding structure 213. The outer conductor of the coaxial transmission line 401 is connected to a second feeding point 213*b*, and the central conductor of the coaxial transmission line 401 is connected to a first feeding point 213*a*. Consequently, the first and second broadband antenna units 301 and 302 are supplied with a feed signal through the transmission line. This type of feeding guarantees that the first and second broadband antenna units 301 and 302 are supplied with a feed signal of the same magnitude and phase.

The first and second broadband antenna units 301 and 302 are symmetrically arranged at a predetermined angle γ therebetween, as described above. This symmetric arrangement of the first and second broadband antenna units 301 and 302 results in higher gain than when a single log periodic antenna is used as the first or second broadband antenna unit 301 or 302. The predetermined angle γ is determined based on the usage of the system to which the antenna is to be applied, i.e. the overall antenna size and ease of fabrication, without significantly degrading the front-to-back ratio on the antenna radiation pattern and the in-band reflection loss characteristics.

Figure 9:
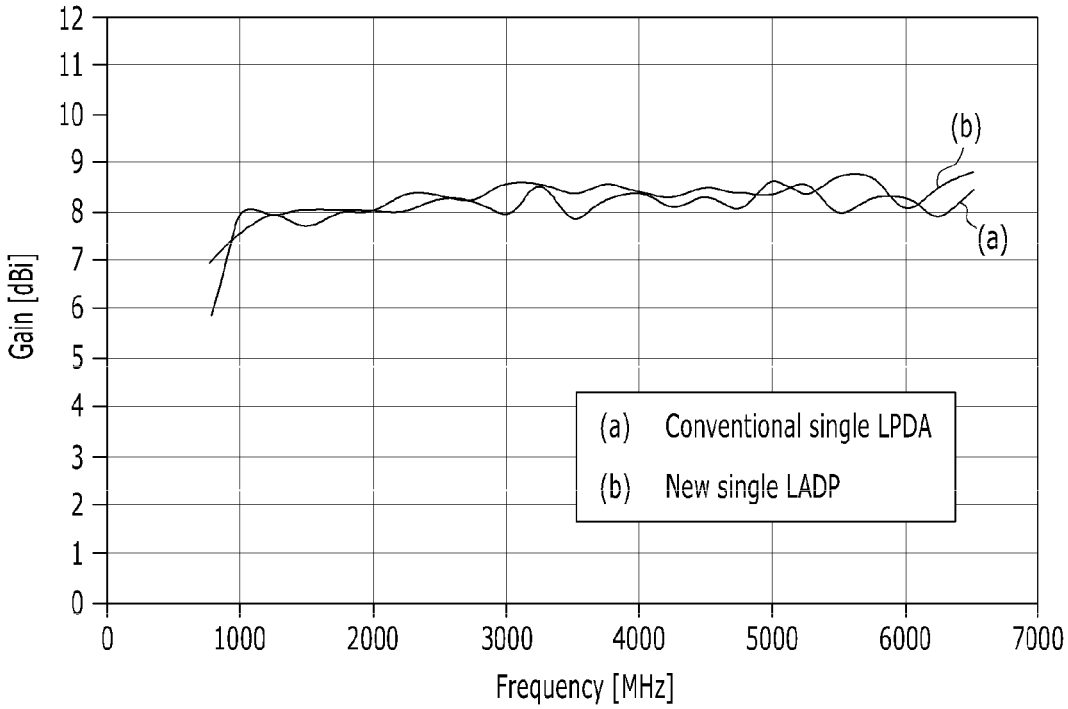
FIG. 9 is a graph showing a comparison on simulation results of gain characteristics of the conventional single LPDA illustrated in FIGS. 1 and 2 and the new single LPDA in accordance with an embodiment of the present invention illustrated in FIGS. 3 and 4.

FIG. 9 is a graph showing a comparison on simulation results of gain characteristics of the conventional log periodic antenna illustrated in FIGS. 1 and 2 (referred to as conventional single LPDA in the graph) and the log periodic antenna in accordance with an embodiment of the present invention illustrated in FIGS. 3 and 4 (referred to as new single LPDA in the graph). The design parameters for simulation are as follows: The number of the dipole radiation elements of the conventional single LPDA and the number of V-shaped broadband radiation elements of the new single LPDA are 23, design parameter 2α is 44.6°, and the boom length B is 215 mm. The height $L_1$ of the longest dipole radiation element of the conventional single LPDA and the height $L_1'$ of the longest broadband radiation element of the new single LPDA are 187 mm and 158 mm, respectively, and the folded angle β of the V-shaped broadband radiation elements of the new single LPDA is 160°.

It is clear from the result of comparison that the gain characteristics of the conventional single LPDA and the new single LPDA show similar tendencies. In other words, the antenna gain does not degrade even if the length of the V-shaped broadband radiation elements is reduced.

Figure 10:
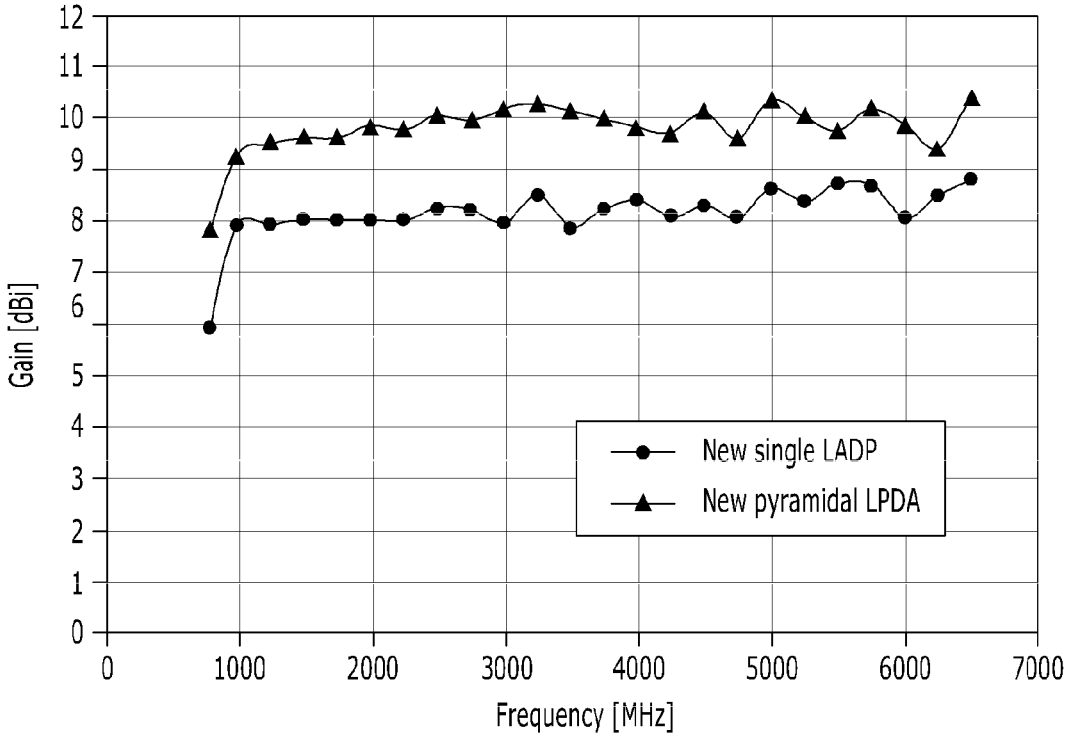
FIG. 10 is a graph showing a comparison on simulation results of gain characteristics between the new single LPDA in accordance with an embodiment of the present invention illustrated in FIGS. 3 and 4 and the new pyramidal LPDA in accordance with another embodiment of the present invention illustrated in FIG. 5.

FIG. 10 is a graph showing a comparison on simulation results of gain characteristics between the log periodic antenna in accordance with an embodiment of the present invention illustrated in FIGS. 3 and 4 (referred to as new single LPDA in the graph) and the pyramidal log periodic antenna in accordance with another embodiment of the present invention illustrated in FIG. 5 (referred to as new pyramidal LPDA in the graph).

This comparison is based on the assumption that the angle □γ between the first and second broadband antenna units 301 and 302 of the pyramidal log periodic antenna in accordance with another embodiment of the present invention illustrated in FIG. 5 is 30°.

It is clear from FIG. 10 that the gain of the new pyramidal LPAD is improved as much as 1.5-2 dB compared with that of the new single LPDA. This means that the directivity is improved.

Figure 11:
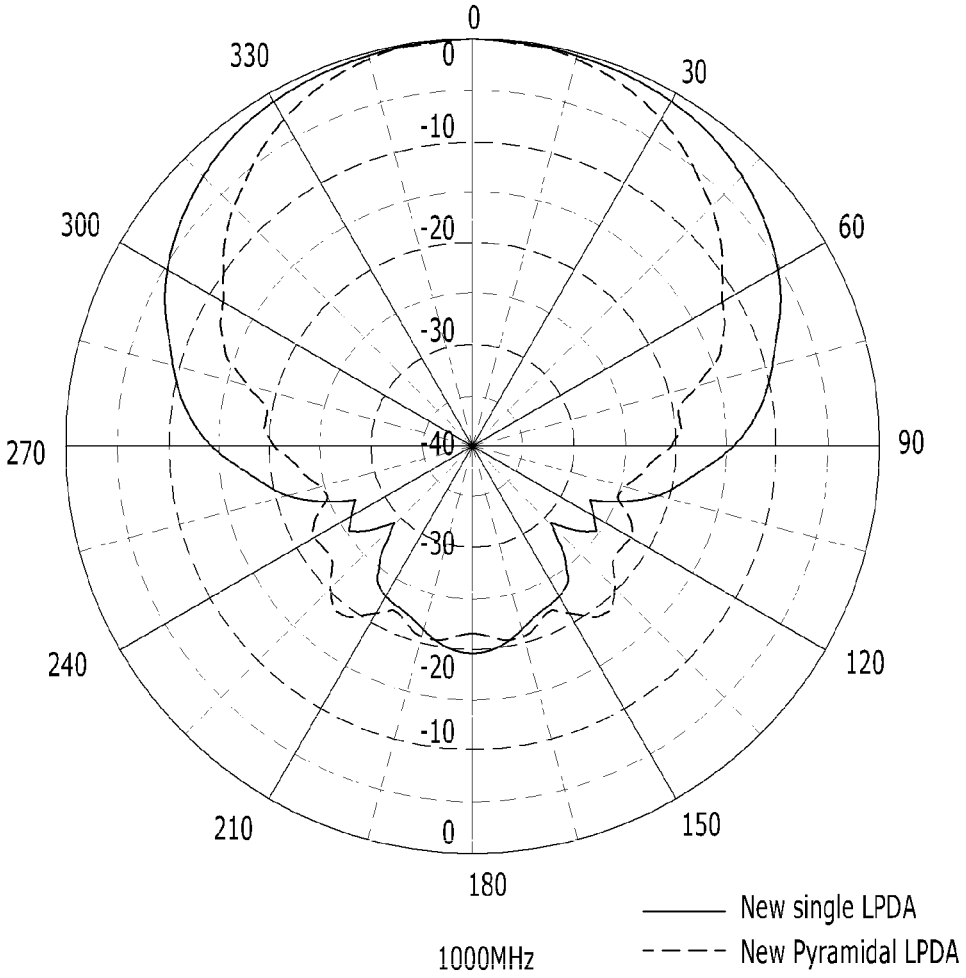
FIGS. 11 to 13 are graphs showing comparison of azimuth-plane radiation patterns.
Figure 12:
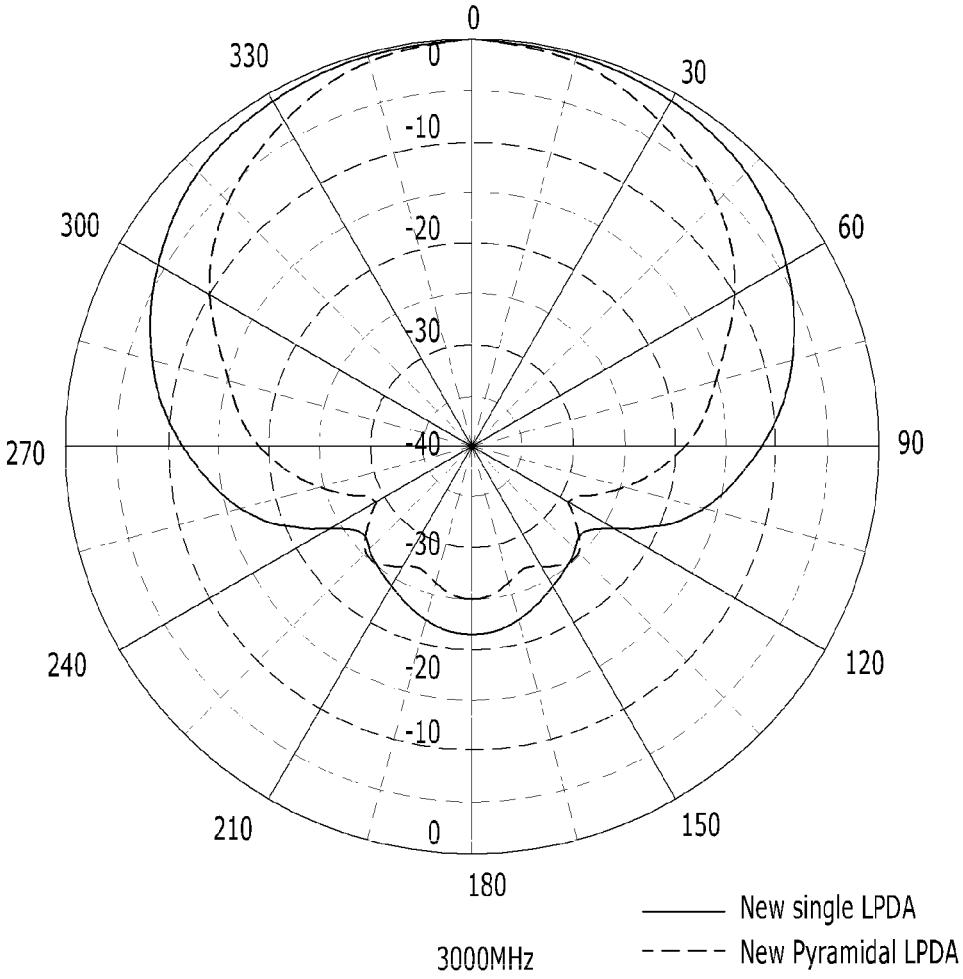
Figure 13:
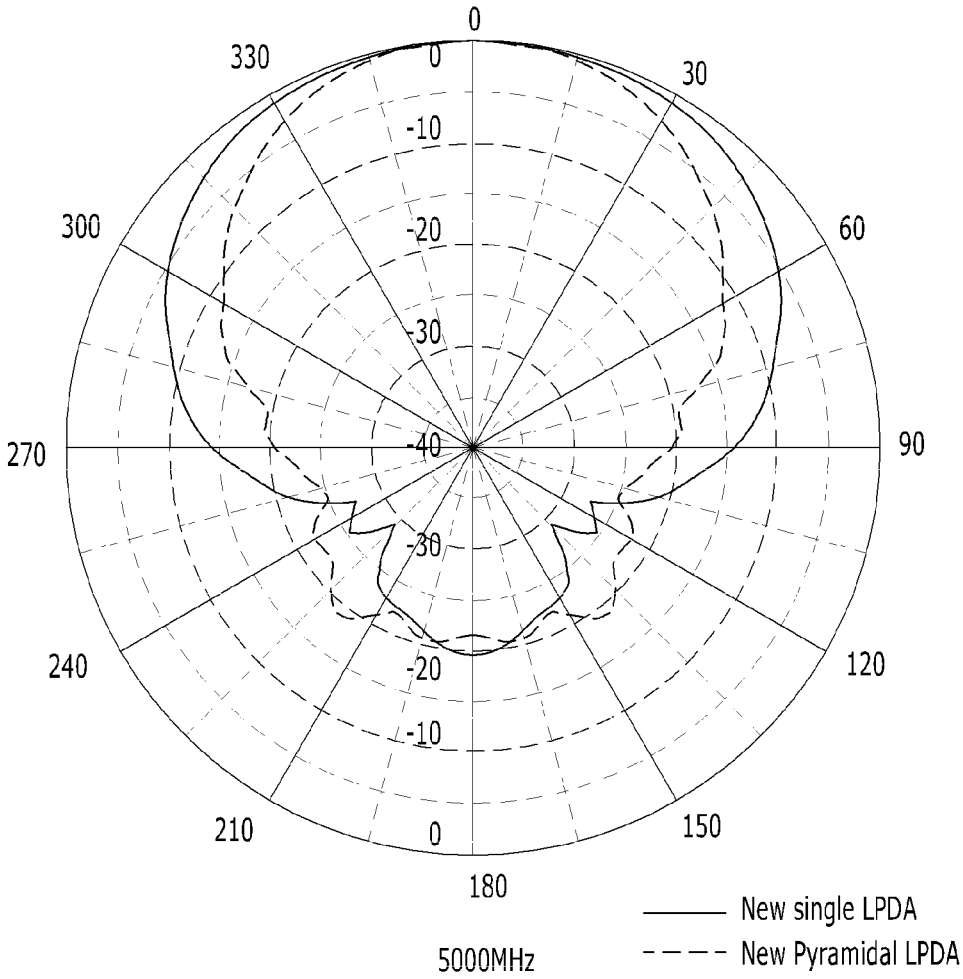
Figure 14:
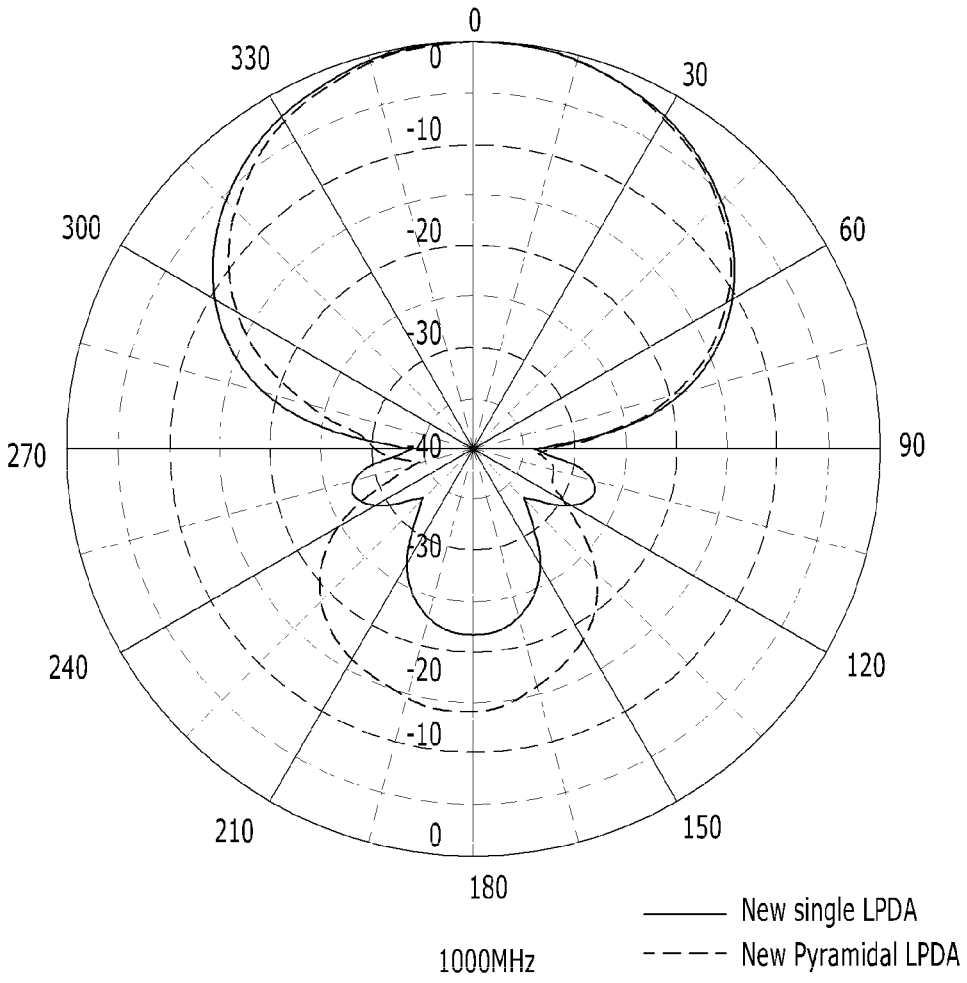
FIGS. 14 to 16 are graphs showing comparison of elevation plane radiation patterns.
Figure 15:
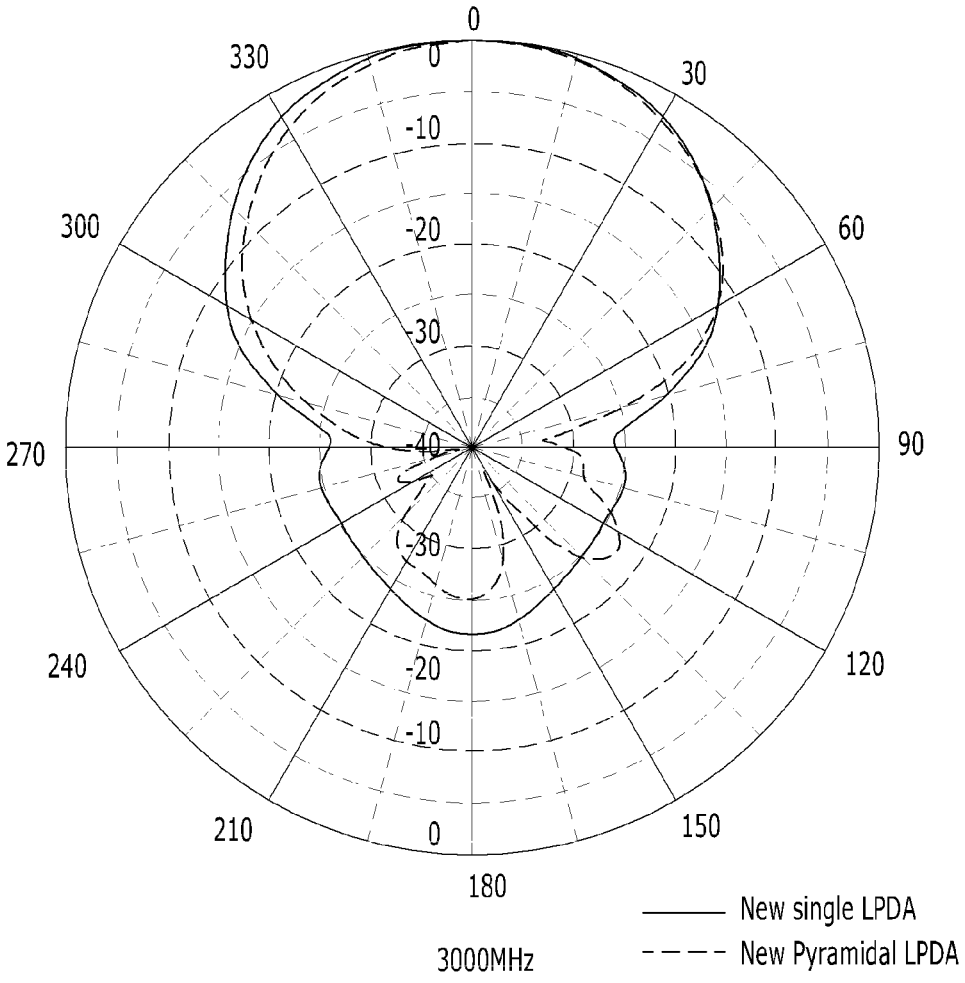
Figure 16:
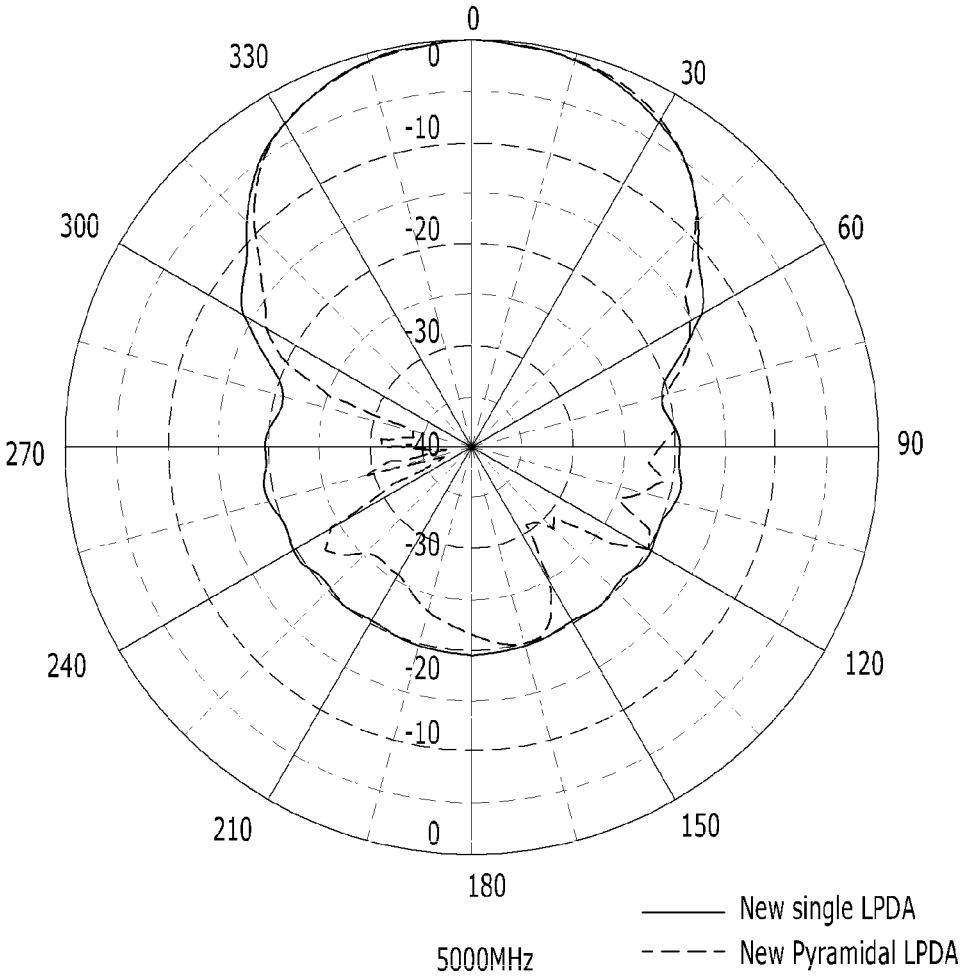

FIGS. 11 to 13 and 14 to 16 are graphs showing the result of simulation and comparison of radiation patterns when the operating frequency is 1000, 3000, and 5000 MHz, respectively, between the log periodic antenna in accordance with an embodiment of the present invention illustrated in FIG. 3 (referred to as new single LPDA in the graphs) and the pyramidal log periodic antenna in accordance with another embodiment of the present invention illustrated in FIG. 5 (referred to as new pyramidal LPDA in the graphs). Specifically, FIGS. 11 to 13 are graphs showing comparison of azimuth plane radiation patterns, and FIGS. 14 to 16 are graphs showing comparison of elevation plane radiation patterns.

It is clear from the azimuth plane radiation patterns shown in FIGS. 11 to 13 that compared with the new single LPDA, the new pyramidal LPDA has a substantially reduced beam width. Specifically, in each operating frequency band, the new single LPDA has a 3 dB beam width of about 100°, and the new pyramidal LPDA has a 3 dB beam width of about 65°. This means that, together with the graph result shown in FIG. 10, the beam width is reduced and the directivity is improved.

Figure 17:
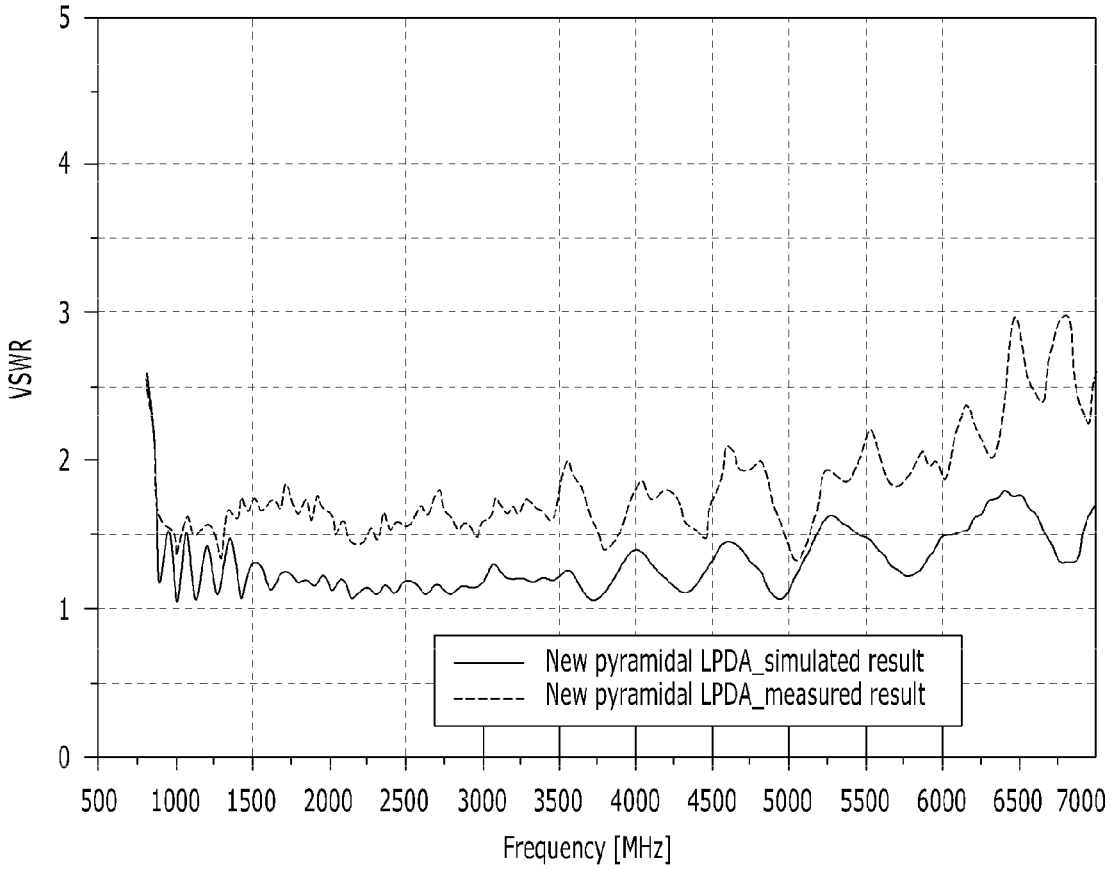
FIG. 17 is a graph showing VSWR characteristics of the pyramidal log periodic antenna in accordance with another embodiment of the present invention illustrated in FIG. 5.

It is clear from the elevation plane radiation patterns shown in FIGS. 14 to 16 that the new single LPAD and the new pyramidal LPAD have a similar 3 dB beam width of about 60°. FIG. 17 is a graph showing VSWR characteristics of the pyramidal log periodic antenna in accordance with another embodiment of the present invention illustrated in FIG. 5. Specifically, FIG. 17 shows comparison between a measurement result (New pyramidal LPDA_measured_result) and a simulation result (New pyramidal LPDA_simulated_result). It is clear from FIG. 17 that, within a margin of error, the measurement and simulation results have a value of about 2:1 or less within operating frequencies of 1000-6000 MHz.

In accordance with the exemplary embodiments of the present invention, the log periodic antenna has a reduced 3 dB beam width of the H-plane radiation pattern and high-gain directivity. The log periodic antenna is capable of maintaining broadband characteristics. The log periodic antenna has a volume smaller than a conventional log periodic antenna. The log periodic antenna can be fabricated and assembled easily and can be carried conveniently. The log periodic antenna can accurately find the direction in a system (e.g. portable direction finding system) requiring a higher directivity than a conventional log periodic dipole antenna.

While the present invention has been described with respect to the specific embodiments, it will be apparent to those skilled in the art that various changes and modifications may be made without departing from the spirit and scope of the invention as defined in the following claims.

What is claimed is:

1. A log periodic antenna comprising:

first and second transmission lines extending parallel with each other in a predetermined direction; and a plurality of broadband radiation elements having first end portions that extend from opposite sides of the first transmission line and a further plurality of broadband radiation elements having first end portions that extend from opposite sides of the second transmission line, a predetermined angle being defined between the first end portions of the broadband radiation elements and the first and second transmission lines, the broadband radiation elements additionally having second end portions respectively extending from each of the first end portions, wherein the broadband radiation elements extending from the first transmission line and the broadband radiation elements extending from the second transmission line are positioned to alternate with each other in the direction of the first and second transmission lines, wherein the second end portions comprise flat panel members that have generally triangular radiation surfaces that are larger than radiation surfaces of the first end portions, and wherein the second end portions are arranged in free space.

2. The log periodic antenna of claim 1, wherein the predetermined angle is an acute angle.

3. The log periodic antenna of claim 1, wherein each of the broadband radiation elements has a length gradually increasing from first ends of the first and second transmission lines, a feed signal being applied to the first ends, towards second ends opposite the first ends.

4. The log periodic antenna of claim 1, wherein the log periodic antenna further comprises:

a first broadband antenna unit comprising the first and second transmission lines and the plurality of broadband radiation elements;

a second broadband antenna unit comprising another first transmission line, another second transmission line, and another plurality of broadband radiation elements; and a feeder configured to supply the first and second broadband antenna units with a feed signal, wherein the first and second broadband antenna units are symmetrically arranged in a pyramidal shape while sharing the feeder with each other.

5. The log periodic antenna of claim 4, wherein the first and second broadband antenna units have an included angle ($\gamma$) of $0° < \gamma < 180°$.

6. The log periodic antenna of claim 4, wherein the second end portions of the plurality of broadband radiation elements not electrically connected with the first and second transmission lines have polygonal radiation surfaces.

7. The log periodic antenna of claim 4, wherein each of the plurality of broadband radiation elements has a length gradually increasing from first ends of the first and second transmission lines, a feed signal being applied to the first ends, towards second ends opposite the first ends.

8. The log periodic antenna of claim 4, wherein the feeder comprises:

a first feeding point configured to electrically connect the first transmission line of the first broadband antenna unit with the first transmission line of the second broadband antenna unit; and a second feeding point configured to electrically connect the second transmission line of the first broadband antenna unit with the second transmission line of the second broadband antenna unit, wherein the first feeding point is electrically connected with a central conductor of a coaxial line, and the second feeding point is electrically connected with an outer conductor of the coaxial line.

9. The log periodic antenna of claim 1, wherein the first end portion of each broadband radiation element has a substantially constant width, wherein the width of the broadband radiation element increases abruptly at a location where the first end portion joins the second end portion, and wherein the width of the second end portion thereafter gradually becomes smaller.

* * * * *